US011618045B2

(12) United States Patent
Brunet

(10) Patent No.: US 11,618,045 B2
(45) Date of Patent: Apr. 4, 2023

(54) DEVICE FOR DISPENSING A FLUID PRODUCT

(71) Applicant: APTAR FRANCE SAS, Le Neubourg (FR)

(72) Inventor: Dominique Brunet, Barc (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 17/415,075

(22) PCT Filed: Dec. 16, 2019

(86) PCT No.: PCT/FR2019/053079
§ 371 (c)(1),
(2) Date: Jun. 17, 2021

(87) PCT Pub. No.: WO2020/128269
PCT Pub. Date: Jun. 25, 2020

(65) Prior Publication Data

US 2022/0062933 A1 Mar. 3, 2022

(30) Foreign Application Priority Data

Dec. 19, 2018 (FR) ..... 1873361

(51) Int. Cl.
*B05B 11/00* (2006.01)

(52) U.S. Cl.
CPC ..... *B05B 11/3069* (2013.01); *B05B 11/0044* (2018.08); *B05B 11/3047* (2013.01)

(58) Field of Classification Search
CPC ..... B05B 11/3069; B05B 11/0044; B05B 11/3047; B05B 11/3025
See application file for complete search history.

(56) References Cited

U.S. PATENT DOCUMENTS 4,245,967 A * 1/1981 Busselet ..... B05B 11/3025 417/510
4,856,677 A * 8/1989 Brunet ..... B05B 11/3025 222/321.2

(Continued)

FOREIGN PATENT DOCUMENTS

DE 2708155 A * 11/1977 ..... B05B 11/3001
EP 1 506 818 A1 2/2005

(Continued)

OTHER PUBLICATIONS

Written Opinion for PCT/FR2019/053079 dated May 4, 2020 (PCT/ISA/237).

(Continued)

*Primary Examiner* — Bob Zadeh
(74) *Attorney, Agent, or Firm* — Sughrue Mion, PLLC

(57) ABSTRACT

A pump for a fluid product having a pump body held in place by a valve holder fastened in the pump body; a piston sliding around a rod, provided with an inner axial channel axially closed on the lower side of the rod and communicating with the outside of the rod via a radial orifice, the piston having an outer sealing lip and an inner sealing lip; a gland having upwards an oblique or frustoconical surface of inclination appropriate to that of the inner sealing lip of the piston; an actuating spring between the rod and piston; and a return spring between the valve holder and the rod, urging the piston towards its rest position. The valve holder has an axial sleeve having an axial rib forming a mechanical stop in the actuating position between the lower axial end of the rod and the rib.

8 Claims, 3 Drawing Sheets

(56) References Cited

U.S. PATENT DOCUMENTS

Figure 1:
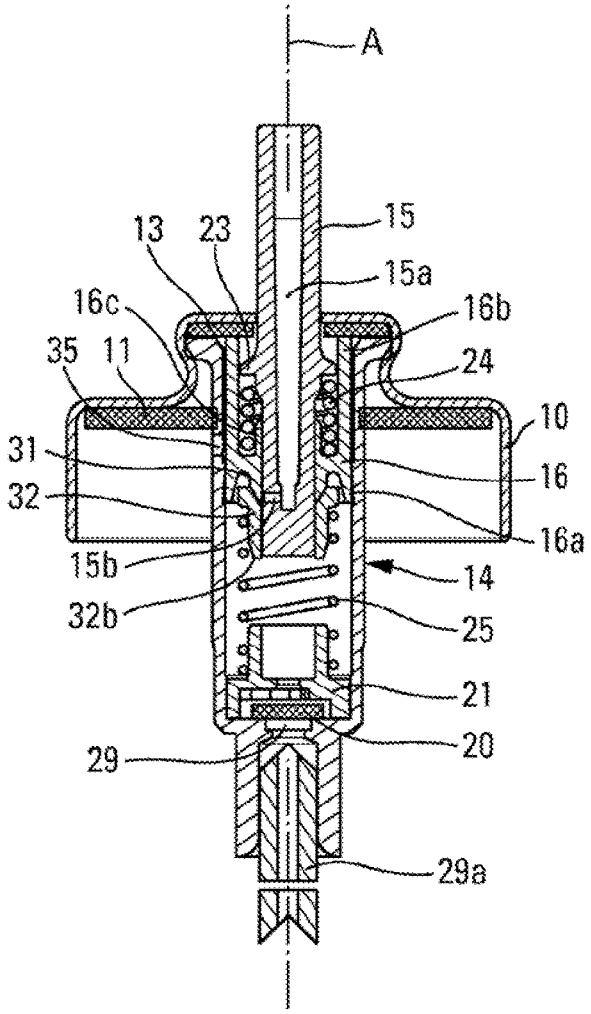
Fig. 1 PRIOR ART

| | | | | |
|---|---|---|---|---|
| 6,186,371 | B1 * | 2/2001 | de Pous | B65D 83/207 222/380 |
| 2004/0230357 | A1 * | 11/2004 | Kobayashi | B05B 11/0044 701/31.4 |
| 2006/0243750 | A1 * | 11/2006 | Pietrowski | B05B 11/3067 222/321.7 |
| 2008/0041894 | A1 * | 2/2008 | Schliemann | B05B 11/3001 222/321.9 |
| 2014/0138409 | A1 * | 5/2014 | Beranger | B05B 11/3001 222/321.2 |
| 2015/0238989 | A1 * | 8/2015 | Zavarella | B05B 11/3098 222/383.1 |
| 2022/0062933 | A1 * | 3/2022 | Brunet | B05B 11/3025 |

FOREIGN PATENT DOCUMENTS

| | | | |
|---|---|---|---|
| FR | 2 343 137 | A1 | 9/1977 |
| WO | WO 92/01183 | A1 | 1/1992 |
| WO | WO 2004/054724 | A1 | 7/2004 |

OTHER PUBLICATIONS

International Search Report for PCT/FR2019/053079 dated May 4, 2020 (PCT/ISA/210).

International Preliminary Report on Patentability with translation of Written Opinion dated Jun. 16, 2021, in International Application No. PCT/FR2019/053079.

* cited by examiner

DEVICE FOR DISPENSING A FLUID PRODUCT

CROSS REFERENCE TO RELATED APPLICATIONS

This application is a National Stage of International Application No. PCT/FR2019/053079 filed Dec. 16, 2019, claiming priority based on France Patent Application No. 1873361 filed Dec. 19, 2018.

The present invention relates to a pump for dispensing a fluid product.

The documents FR 2 343 137 and FR2403465 describe a device with a pump comprising a pump body in which a piston can move, mounted to slide on an actuating rod, the urging force exerted on the rod by the user being transmitted to the piston by means of a spring, so that, by actuating the actuating rod, a relative movement of the piston relative to the rod occurs.

However, this pump has certain drawbacks. Thus, the dose dispersion between successive doses is relatively large. In particular, in the event of non-axial actuation by the user, the operation of the pump may be negatively impacted.

Documents WO 9201183, U.S. Pat. No. 4,856,677, WO 2004054724, et EP 1506818 describe other prior-art devices.

An object of the present invention is to provide a fluid dispenser pump that does not have the above-mentioned drawbacks.

Another object of the present invention is to provide a pump for dispensing a fluid product that improves the dose reproducibility between successive doses.

Another object of the present invention is to provide a pump for dispensing a fluid product that improves operational reliability, in particular in the case of non-axial actuation.

Another object of the present invention is to provide a pump for dispensing a fluid product that is simple and inexpensive to manufacture and assemble.

The present invention therefore relates to a pump for dispensing a fluid product comprising:

- a pump body, comprising an opening closed by an inlet valve, held in place by a valve holder fastened in said pump body,
- a piston sliding in a sealed manner in said pump body, around a hollow rod, provided with an inner axial channel axially closed on the lower side of said rod and communicating with the outside of the rod via a radial orifice, said piston comprising, on an outer radial edge, an outer sealing lip for ensuring the sealing with respect to said pump body, and on an inner radial edge, an inner sealing lip, for ensuring the sealing with respect to said rod,
- a gland cooperating with said inner sealing lip of said piston,
- an actuating spring disposed between said rod and said piston,
- a return spring disposed between said valve holder and said rod, biasing said piston towards its rest position, said valve holder comprising an axial sleeve receiving said rod in the actuating position, said axial sleeve comprising at least one axial rib, for forming a mechanical stop in the actuating position of the pump between the lower axial end of said rod and said at least one axial rib of said valve holder.

Advantageously, said axial sleeve comprises at least two axial ribs.

Advantageously, four axial ribs extend two by two in diametrically-opposite manner around an axial opening of said valve holder.

Advantageously, a through hole is formed in said axial sleeve to ensure the passage of the liquid in the actuating position.

Advantageously, a fastening ring is provided for fastening said pump body to a container with a neck seal interposed therebetween, a ring seal being provided for ensuring the sealing of said fastening ring with said pump body.

Advantageously, in the rest position, an upper axial edge of said piston cooperates in a sealed manner with said ring seal.

Advantageously, a vent is provided in said pump body to allow the product expelled by the pump to be replaced by air on each actuation.

The present invention also relates to a device for dispensing a fluid product including a pump as described above.

Figure 2:
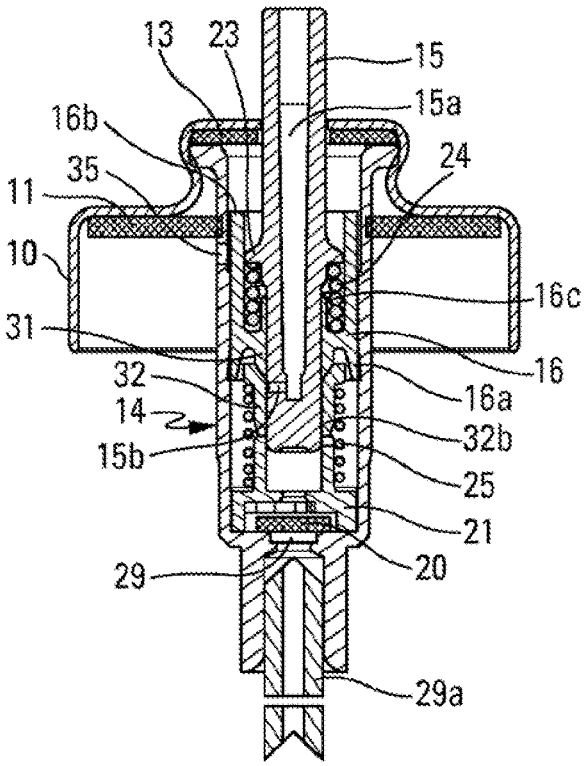
Fig. 2 PRIOR ART
Figure 3:
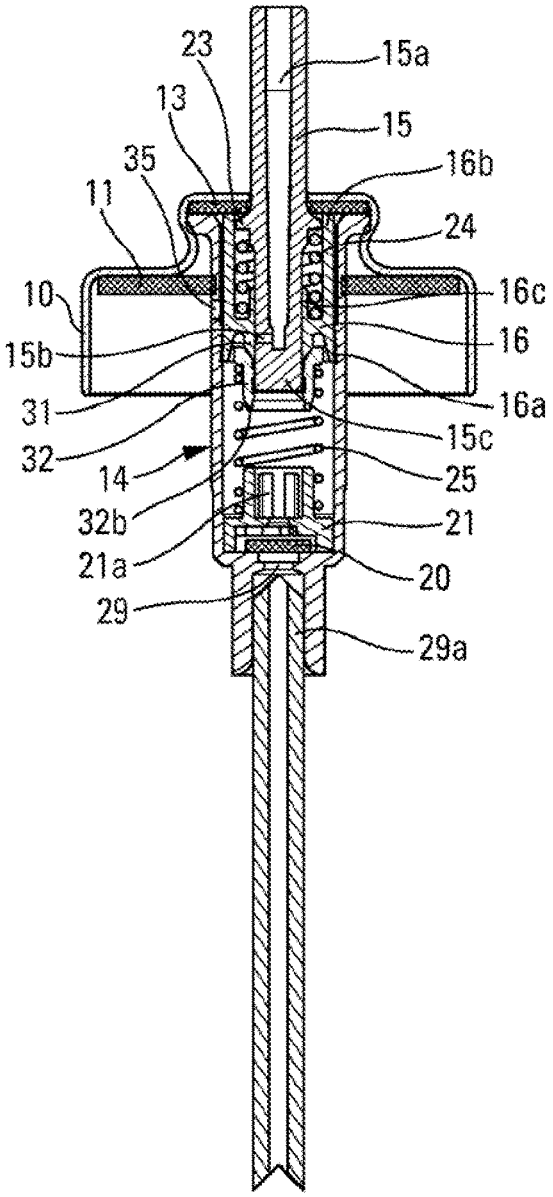
Figure 4:
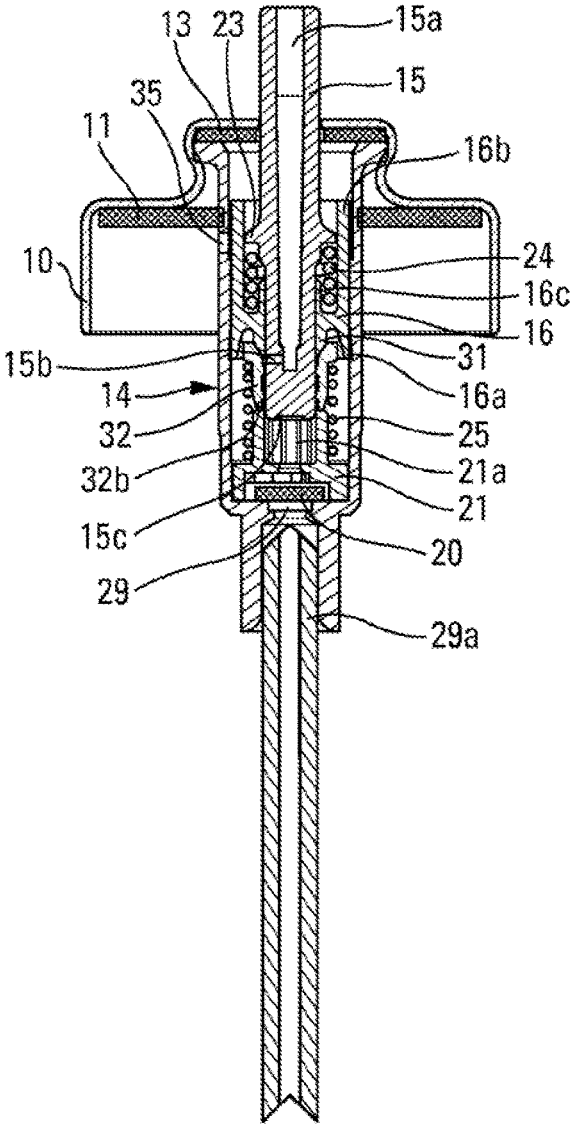
Figure 5:
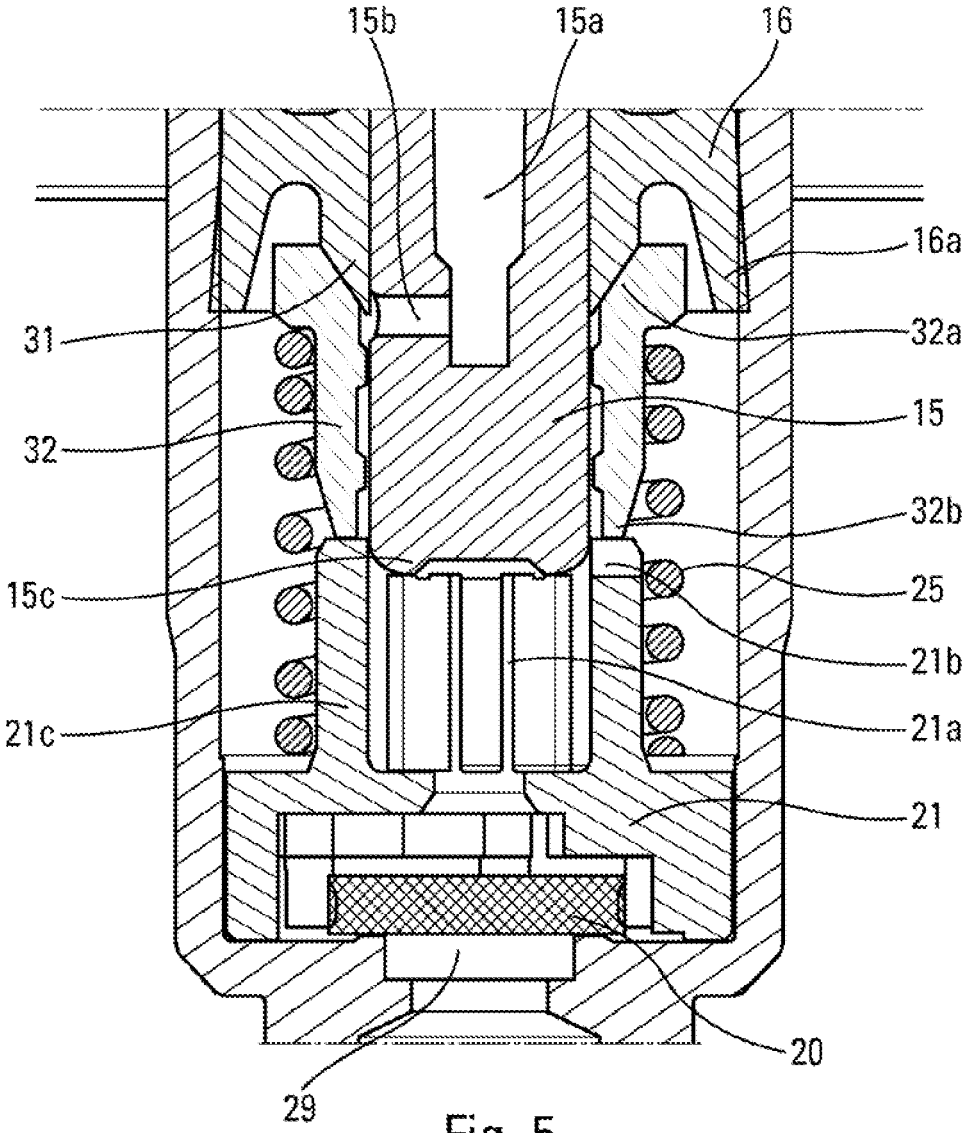
Figure 6:
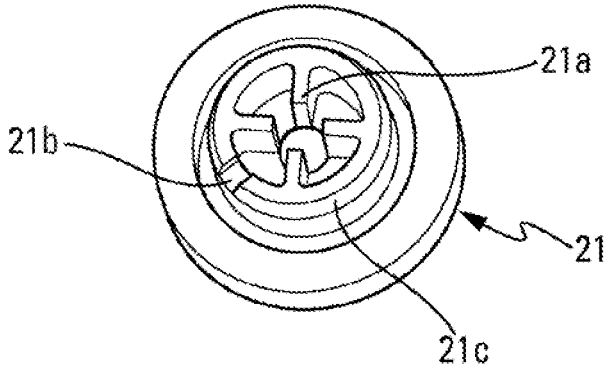

These and other characteristics and advantages appear more clearly from the following detailed description, given by way of non-limiting example, and with reference to the accompanying drawings, in which:

FIG. 1 is a schematic cross-sectional view of a pump for dispensing a fluid product of the prior art, in the rest position, FIG. 2 is a schematic view similar to that of FIG. 1, in the actuating position, FIG. 3 is a schematic cross-sectional view of a pump for dispensing a fluid product according to an advantageous embodiment of the invention, in the rest position, FIG. 4 is a schematic view similar to that of FIG. 3, in the actuating position, FIG. 5 is an enlarged partial schematic view of a portion of the pump of the FIG. 4, and FIG. 6 is a schematic perspective view of a valve holder.

In the description, the terms "upper", "lower", "top", and "bottom" refer to the upright position of the device shown in FIGS. 1 to 4. The terms "axial" and "radial" refer to the vertical central axis A of the pump, shown in FIG. 1.

With reference to the figures, the pump comprises a pump body 14.

A fastening ring 10 is provided for fastening the pump body 14 to the neck of a container (not shown) with a neck seal 11 interposed therebetween. A ring seal 13 ensures the sealing of the fastening ring 10 with the pump body 14.

A piston 16 slides in a sealed manner in the pump body 14, around a hollow rod 15, with an inner axial channel 15*a*.

An outer radial edge of the piston 16 forms an outer sealing lip 16*a*, for ensuring the sealing with respect to the internal surface of the pump body 14.

An upper axial edge 16*b* of the piston 16 ensures, at rest, the sealing with respect to the ring seal 13.

The inner axial channel 15*a* opens axially towards the top of the rod 15. Towards the bottom, the channel 15 *a* is axially closed and communicates with the outside of the rod via a radial orifice 15*b*.

The pump body 14 is closed at the bottom by an inlet valve 20, held in place by a valve holder 21. This inlet valve closes an opening 29, communicating with the interior of the container, and to which a dip tube 29*a* can be connected, in the well-known conventional manner.

The rod 15 has a shoulder 23 against which an actuating spring 24 is pressed, applied on the other side against the piston 16. This actuating spring 24 serves to transmit the pressure force from the rod 15 to the piston 16. The shoulder 23 also serves to limit the upward movement of the rod 15, by forming a stop with the ring seal 13.

A return spring 25 bias the piston 16 upwards and, with it, the rod 15 by means of the actuating spring 24.

When the pump is at rest, the upper edge 16*b* of the piston 16 is applied against the ring seal 13.

The sealing between the piston 16 and the rod 15 is ensured by an internal portion of the piston 16, preferably of conical shape, forming an inner sealing lip 31. In order to improve the sealing, it is also possible, if necessary in certain cases (for example, very fluid product or high pressure required), to provide an extension 16*c* of the piston toward the top of the rod 15.

At rest, the orifice 15*b* is perpendicular to the lip 31, so as to be perfectly closed. The sealing between the outside and the inside of the container is therefore ensured on the one hand by the contact between the edge 16*b* and the seal 13, and on the other hand between the inner sealing lip 31 and the rod 15.

In order to improve the sealing and to improve the working conditions of the lip 31, the pump comprises a bearing piece or gland 32, as can be better seen in FIG. 5, and comprising upwards an oblique or frustoconical surface 32*a* of inclination appropriate to that of the inner sealing lip 31 of the piston 16.

The force exerted by the return spring 25 on the piston 16 is thus transmitted by the gland 32.

The lower surface 32*b* of the gland 32 serves as a stop against the valve holder 21, in order to limit the downward stroke of the piston 16.

At rest, the force exerted by the return spring 25 must be greater than that which is exerted by the actuating spring 24, so that the upper edge 16*b* of the piston 16 is suitably applied to the ring seal 13. When the rod 15 is pressed, the force exerted by the actuating spring 24 rapidly increases and substantially exceeds the force exerted by the return spring 25 so that the difference in the thrusts exerted by the springs 24, 25 corresponds to the desired pressure in the lower portion of the pump body 14.

A vent 35 is provided in the pump body to allow the product expelled by the pump 14 to be replaced by air on each actuation.

The pump described above operates as follows. At rest, the sealing inside the container is ensured by the neck seal 11 between the ring 10 and the container (not shown), by the ring seal 13 between the ring 10 and the pump body 14, by the contact between the upper edge 16*b* of the piston 16 and the ring seal 13, and by the inner sealing lip 31 of the piston 16 against the rod 15.

The container, not shown in the drawings, and which may be any, is filled with a liquid, in particular a pharmaceutical liquid, to be dispensed, in particular to be sprayed.

The fastening ring 10 may be made of metal or plastic. It may be crimped, screwed, snap-fitted or otherwise fastened to the container.

The user must first prime the pump by operating it to expel the air until the lower portion of the pump body 14 is filled with liquid.

The user then pushes the rod 15. The liquid being practically incompressible, the piston 16 will move little and the actuating spring 24 will compress. The pressure of the liquid increases all the more as the lower end of the rod 15 sinks into the pump body 14. When the pressure manages to equalize the force of the actuating spring 24, except the force of the return spring 25, the piston 16 no longer descends and the rod 15, by continuing to sinks, expose the orifice 15*b* below the sealing lip 31.

The liquid is rapidly expelled through the orifice 15*b* and the channel 15*a*, towards a dispensing head (not shown) assembled on the pump, and the pressure is kept constant during this operation by the actuating spring 24, which exerts the desired pressure while the orifice 15*b* is open. As soon as the pressure exerted by the user is reduced, or when the lower surface 32*b* of the gland 32 abuts on the seal holder 21, the piston 16, actuated by the actuating spring 24, closes the orifice 15*b*. The dispensing stops, and it is therefore entirely carried out under constant pressure, determined exactly by the choice of the springs.

Thereafter, the user ceases to exert pressure on the rod 15. The actuating spring 24 immediately expands, which ensures the closing of the orifice 15*b*, and the return spring 25 brings the assembly back to the top. Liquid is sucked through the orifice 29, lifting the valve 20, while air replaces this liquid, passing through the central opening of the ring seal 13 around the rod 15, and through the vent 35. When the upper edge 16*b* of the piston 16 comes into contact with the ring seal 13, the air can no longer enter, and the piston 16 is blocked, the pump has returned to its rest position and is ready for a new actuation.

The gland 32 provides an excellent sealing with an inner sealing lip 31 made in the mass of the piston 16, i.e. made of an inexpensive material, which does not require high precision of the characteristics over time and relative to the temperature. The choice of the size of the gland 32, in particular its axial length, makes it possible to adjust the stroke of the piston 16, i.e. the volume of the dose dispensed on each actuation. It is therefore possible, with a single pump model, to obtain very different doses by an appropriate choice of the length of the gland.

One drawback of the prior art pump shown in FIGS. 1 and 2 relates to the dose dispersion.

Thus, the volume of the dose is defined by the volume moved by the sub-assembly consisting of the piston 16 and gland 32, on the one hand, and by the volume moved by the rod 15, on the other hand. Calculations have established that 88% of the geometric dispersion of the dose comes from the volume moved by the sub-assembly consisting of the piston 16 and gland 32, and 12% of this geometric dispersion comes from the volume moved by the rod 15.

However, one drawback of the prior art pump shown in FIGS. 1 and 2 relates to operating reliability in the event of non-axial actuation.

Thus, the actuation stroke end stop of the rod is produced by the actuating spring 24 which is completely compressed, with the contiguous turns. It is therefore a deformable component, because even with contiguous turns, the actuating spring 24 remains relatively flexible. The dose end therefore depends on a deformable component, and on variations according to the actuating force of the user and/or the accuracy of the spring.

In addition, the piston 16 being in contact with the walls of the pump body 14 only through the sealing lip 16*a*, cannot ensure good guidance of the rod. The gland 32, not being in contact with the walls of the pump body 14, does not make it possible to remedy this.

A non-axial actuating force exerted on the rod 15 therefore passes through the actuating spring 24 with contiguous turns and by the cone-to-cone contact between the inner sealing lip 31 of the piston 16 and the oblique surface 32*a* of the gland 32, these flexible elements liable to deform, which generates a malfunction of the pump in the actuating position, also called tilting, capable of generating an undesired modification of the volume of the dispensed dose.

According to the invention, a mechanical stop of the pump is provided between the lower axial end 15*c* of the rod 15 and the valve holder 21, in order to define the end of actuation stroke of the rod 15. To this end, said valve holder 21 includes at least one axial rib 21*a* formed in an axial sleeve 21*c* receiving the rod 15 in the actuating position. To ensure the passage of the liquid beyond said contact, a through hole 21*b* is formed in said axial sleeve 21*c*, as can be seen in FIG. 6.

Preferably, four axial ribs 21*a* are provided, as can be seen in FIG. 6. These axial ribs 21*a* can extend two by two in diametrically-opposite manner around an axial opening 21*d* of said valve holder 21.

This stop formed by the contact, in the actuating position, between the ribs 21*a* of the valve holder 21 and the lower axial end of the rod 15, ensures a transmission of the actuating force directly from the rod 15 to the pump body 14, via the valve holder 21, without risk of deformation of the flexible elements of the pump defining the dose volume. The reproducibility of the dose is therefore improved and the risk of tilting is reduced.

Comparative tests between the prior art pump in FIGS. 1 and 2 and the pump of the invention in FIGS. 3 to 6 have been performed and are shown in the table below.

TABLE 1

| | Prior art | Invention |
|---|---|---|
| Average dose | 96.2 μl | 90.6 μl |
| Standard deviation | 7.6 μl | 3.9 μl |

It can be seen that the present invention generates a slightly lower average dose in volume, but that the standard deviation, i.e. the dose dispersion, is greatly reduced with the present invention. Specifically, this dose dispersion is reduced by 48%, which demonstrates the effectiveness of the present invention, with the reproducibility of the dose between successive actuations which is greatly improved.

The present invention has been described with reference to an advantageous embodiment, but naturally any modification could be applied thereto by the person skilled in the art, without going beyond the ambit of the present invention, as defined by the accompanying claims.

The invention claimed is:

1. A pump for dispensing a fluid product comprising:

a pump body, comprising an opening closed by an inlet valve, held in place by a valve holder fastened in said pump body, a piston sliding in a sealed manner in said pump body, around a hollow rod, provided with an inner axial channel axially closed on a lower side of said rod and communicating with the outside of the rod via a radial orifice, said piston comprising, on an outer radial edge, an outer sealing lip for ensuring the sealing with respect to said pump body, and on an inner radial edge, an inner sealing lip, for ensuring the sealing with respect to said rod, a gland cooperating with said inner sealing lip of said piston, an actuating spring disposed between said rod and said piston, a return spring disposed between said valve holder and said rod, biasing said piston towards a rest position of said piston, wherein said valve holder comprises an axial sleeve receiving said rod in an actuating position, said axial sleeve comprising at least one axial rib, for forming a mechanical stop in the actuating position of the pump between a lower axial end of said rod and said at least one axial rib of said valve holder.

2. The pump according to claim 1, wherein said axial sleeve includes at least two axial ribs.

3. The pump according to claim 2, wherein four axial ribs extend two by two in diametrically-opposite manner around an axial opening of said valve holder.

4. The pump according to claim 1, wherein a through hole is formed in said axial sleeve to ensure the passage of the liquid in the actuating position.

5. The pump according to claim 1, wherein a fastening ring is provided for fastening said pump body on a container with a neck seal interposed therebetween, a ring seal being provided for ensuring the sealing of said fastening ring with said pump body.

6. The pump according to claim 5, wherein, in the rest position, an upper axial edge of said piston cooperates in a sealed manner with said ring seal.

7. The pump according to claim 1, wherein a vent is provided in said pump body to allow the product expelled by the pump to be replaced by air on each actuation.

8. A fluid product dispensing device, comprising a pump according to claim 1.

* * * * *